US005960476A

United States Patent [19]

Danzy

[11] Patent Number: 5,960,476

[45] Date of Patent: Oct. 5, 1999

[54] ARTICLE OF CLOTHING INCLUDING AT LEAST ONE TRANSPARENT PATCH

[76] Inventor: Derrick Dwayne Danzy, 11989 Bucklake Rd., Tallahassee, Fla. 32311

[21] Appl. No.: 09/047,688

[22] Filed: Mar. 25, 1998

[51] Int. Cl.[6] ..... A41B 1/00

[52] U.S. Cl. ..... 2/115; 2/69; 40/586

[58] Field of Search ..... 2/69, 108, 102, 2/105, 106, 115, 94, 244, 246, 243.1, 85, 93, 247–250, 227, 228, 1; 40/586

[56] References Cited

U.S. PATENT DOCUMENTS

| | | | |
|---|---|---|---|
| 1,854,821 | 3/1932 | Barker . | |
| 2,871,485 | 2/1959 | Greco | 2/246 |
| 2,986,743 | 6/1961 | Eilen | 2/115 |
| 3,055,133 | 9/1962 | Anderson | 2/102 |
| 3,582,993 | 6/1971 | Keller | 40/586 |
| 4,625,337 | 12/1986 | Zahn | 40/586 X |
| 4,813,081 | 3/1989 | Cliff et al. | 2/115 |
| 4,924,613 | 5/1990 | Levin | 40/586 |
| 5,173,968 | 12/1992 | Fox | 2/244 |
| 5,175,888 | 1/1993 | Clark | 2/115 X |
| 5,276,985 | 1/1994 | Halloran | 40/586 X |
| 5,347,658 | 9/1994 | Clark | 2/69 |

*Primary Examiner*—Gloria Hale
*Attorney, Agent, or Firm*—Carnes Cona & Dixon

[57] ABSTRACT

The present invention is a line of clothing having at least one through hole. Secured to the through hole is a transparent material. This transparent material can be either clear, colorized, or include magnification properties, for providing a final product which can be customized by the needs and desires of the wearer. The use of transparent material provides a final product which will show case and accentuate tattoos located on an individual.

19 Claims, 2 Drawing Sheets

ARTICLE OF CLOTHING INCLUDING AT LEAST ONE TRANSPARENT PATCH

BACKGROUND OF THE INVENTION

1. Field of the Invention

The present invention relates generally to an article of clothing, such as, but not limited to, shirts, pants, blouses, shorts, or the like, which include at least one transparent patch, which acts as a window and will enhance the viewing of items located under the transparent material, such as tattoos. The patches can be permanent or removable, and can also include any shape, size, color, and/or magnification, so as to display and possibly intensify the item, such as a tattoo, located under the window.

2. Description of the Prior Art

Personal expression has always been a way of identifying one's individuality and personality. Generally, many will use their apparel as a means of expression. Others will enhance their ensemble with jewelry, accessories, or the like. Uniqueness and individuality being ultimately the final goal, some have found that tattoos, body piercing or the like, have offered them the desired means of expression. Unfortunately, when the article of clothing are worn, these tattoos are typically concealed.

Those in the apparel industry have sought to find new and unique items which allow the wearer to express their own individuality. One such article of clothing is disclosed in U.S. Pat. No. 1,854,821 issued to Barker. This article is preferably a swimsuit with a removable patch. The patch can include any design, such as a picture of a butterfly or star as shown by Barker. Though this article may offer some individuality, it does suffer some shortcomings, by providing an article of clothing with a limited amount of interchangeable patches. In addition, after several washes, the article may be more faded than the patches. Hence, when wearing the article with the desired patch, the final product may be an eye sore and not a statement. Thereby, defeating its intended purpose.

Yet another apparel is disclosed in U.S. Pat. No. 4,813,081 issued to Cliff et al. Here, there is disclosed an article of clothing in the form of a novelty-garment for artistic expression by introducing simple modifications which achieve blending of the wearer of the garment with the design printed on the garment to make flesh of the wearer a major part of the design on the garment. Though this is a unique means of combining one's flesh with a design for displaying a particular design, this approach is more humorous in nature. Something that is often undesired by the individualists.

In addition, for the tattoo enthusiasts, none of these items identify above offer a means of displaying the tattoo. Hence, as with conventional apparel, the clothing identify above, conceal and hide any tattoo located on the individual. Accordingly, it is seen that there exists a need for a line of clothing specifically designed and configured to adequately and efficiently display a tattoo.

For these reasons it is seen that the previous efforts do not provide the benefits intended with the present invention, such as providing a means of adequately displaying a tattoo located on an individual. Additionally, prior techniques do not suggest the present inventive combination of component elements as disclosed and claimed herein. The present invention achieves its intended purposes, objectives and advantages over the prior art apparel through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a line of clothing, such as, but not limited to, shirts, blouses, pants, shorts, or the like, having at least one transparent patch. This will provide a final product which will adequately and efficiently display a tattoo.

The patch can be permanently secured to the article of clothing or optional, and preferably, is removably secured to the article of clothing via a securing means. This securing means can be any conventional securing means, such as the use of VELCRO (hook and loop fastener), snaps, or the like.

For enhancing the tattoo, the patch can be fabricated from a material which is not only transparent but can include magnification properties. This type of material is conventional and well known. Magnification will provide a final product that accentuates the tattoo. For more versatility, the transparent patch can be any size, dimension, configuration and/or color. Each particular item will add to the appeal and statement of the displayed tattoo.

The line of clothing can be fabricated from breathable material, making the final product comfortable to the wearer. This breathable material is particularly suited for use in hot and humid environments, offering a means of dissipating heat.

Accordingly, it is the object of the present invention to provide for a line of clothing which will overcome the deficiencies, shortcomings, and drawbacks of prior novelty clothing apparel by providing a line of clothing specifically design for tattoo display.

Still another object of the present invention is to provide a transparent patch which will accentuate a tattoo and will further enhance its display via the color, magnification, size and shape of the patch.

Yet another object of the present invention, to be specifically enumerated herein, is to provide a transparent patch within an article of clothing in accordance with the preceding objects and which will conform to conventional forms of manufacture, be of simple construction and easy to use so as to provide an article of clothing that would be economically feasible, long lasting and a definite fashion need for those who have tattoos, by providing an adequate means of display.

Although there have been many inventions related to a clothing apparel, none of the inventions have disclosed a means of adequately displaying a tattoo. The present invention meets the requirements of the simplified design, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
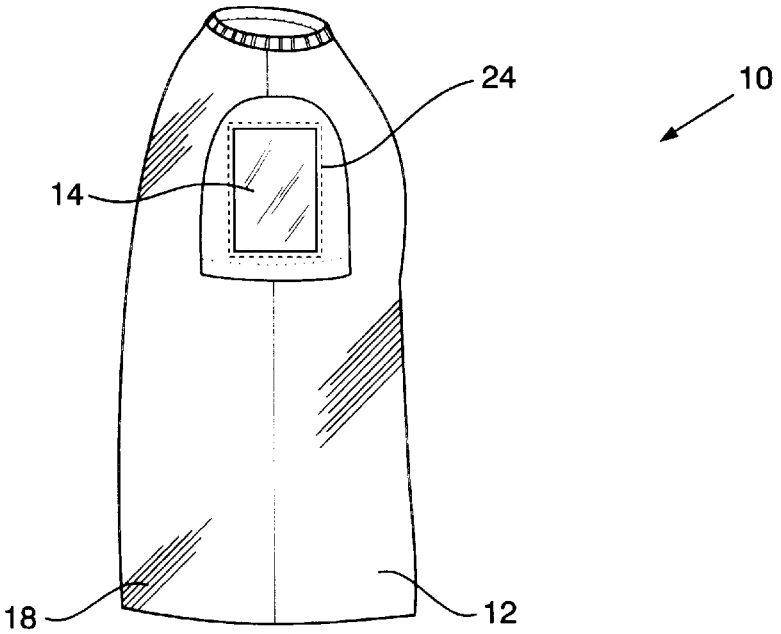
FIG. 1 is a side planar view of an example of a line of clothing including the transparent patch according to the present invention.

As seen in the drawings, in particular to FIGS. 1–4, there is shown the present invention 10 which is a line of clothing 12 having at least one transparent patch 14. It is noted that the line of clothing 12 illustrated in the present invention 10 is a shirt, however, it is noted that other articles of clothing can be used, such as, but not limited to pants, shorts, blouses, or the like.

Figure 2:
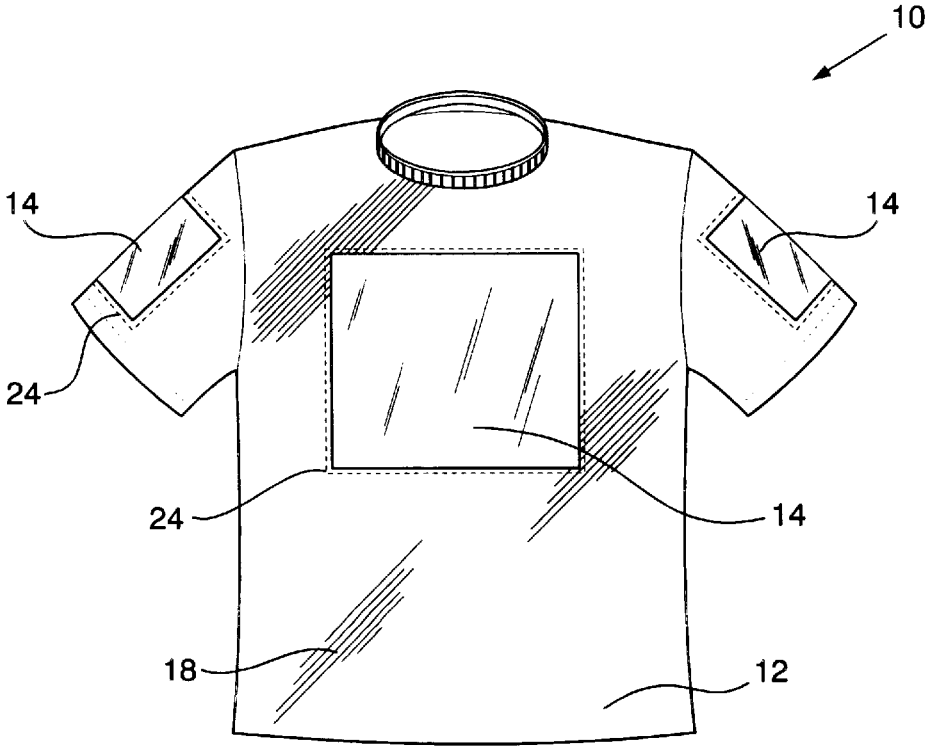
FIG. 2 is a front planar view illustrating a second example of a line of clothing including a plurality of transparent patches according to the present invention.
Figure 3A:
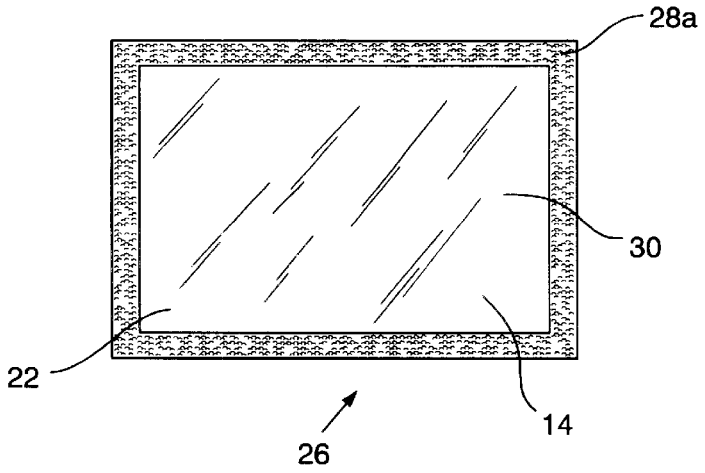
FIG. 3*a* is a detail front view of an alternative form of the patch used in the line of clothing of the present invention.
Figure 3B:
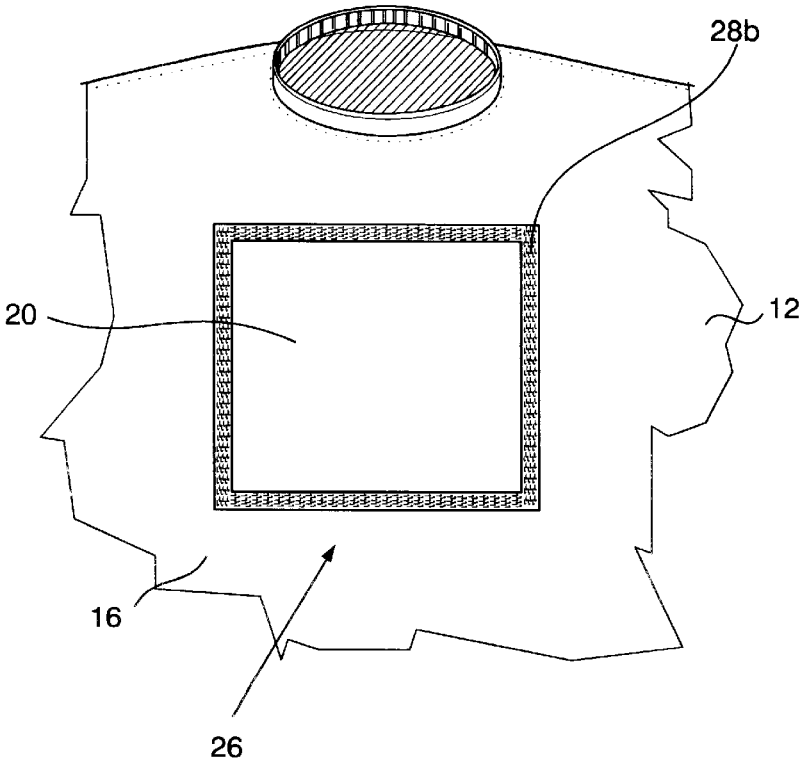
FIG. 3*b* is a partial interior view of the line of clothing, excluding the patch, illustrating the attaching means of the present invention.

As seen in FIGS. 1 and 2, the present invention, the article of clothing includes an interior surface 16, illustrated in FIG. 3*b*, and an exterior surface 18. The interior surface 16 will face the wearer. Extending through the garment 12 is at least one through hole 20, illustrated and labeled in FIG. 3*b*. This through can be any size, shape or dimension and is designed and configured to frame a tattoo located on the wear's skin. In this arrangement, the user can adequately display and exhibited their tattoo, generally concealed via conventional form of apparel.

Secured to the interior surface of garment 12, under or over the through hole 20 is the patch 14 fabricated from a transparent material 22, labeled in FIG. 3*a*. This transparent material 22 will offer some protection to the user's skill and will also assists in showcasing the tattoo on display.

Figure 4:
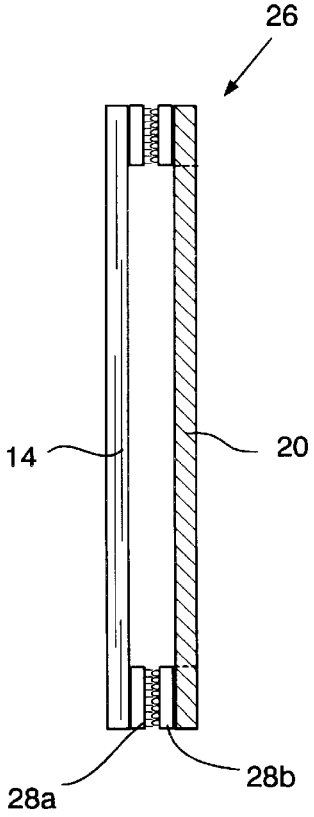
FIG. 4 is an exploded cross sectional view of the patch attached to an article of clothing.

The transparent patch 14 made from the transparent material 22 can be either permanently secured via a permanent securing means 24 to the garment 12, as illustrated in FIGS. 1 and 2, or can be removably secured to the garment 12 via a removable securing means 26, as illustrated in FIGS. 3*a*–4.

In the permanent attachment the permanent securing means 24 can be stitches for permanently securing the patch to the garment. Optionally, the permanent attachment can also include other permanent attaching means, such as the use of adhesives or the like.

The removable securing means 26, illustrated in further detail in FIGS. 3*a*–4, can include any conventional removable attaching means, such as snaps, zippers, or, as illustrated, the use of hook and loop fastener, known as VELCRO. In this preferred embodiment, the VELCRO (hook and loop fastener) 28*a* will be located on an upper surface 30 of the transparent material 22. Secured to the interior surface 16 of the garment 12, around the perimeter of the through hole 20 is cooperating VELCRO (hook and loop fastener) 28*b*. The VELCRO (hook and loop fastener) will be arrange in proximity to the edge of the transparent material 22. In this design and configuration, the transparent material 22 will be removably secured to the garment via the securing means 26.

Optionally, the patch 14 can be removably secured to the exterior surface 18 of the line of clothing 12. This will provide for the exterior surface to include the removable securing means so as to provide for the patch to be removably secured to the line of clothing exteriorly. The removable securing means will be secured to the exterior surface of the garment, around the perimeter of the through hole. In this arrangement, removing, securing, and changing the patch can be accomplished more easily than as described and illustrated above.

The transparent material 22 and the through hole 20 can be any shape and configuration, so as to adequately display the tattoo located thereunder. The shape can be also be configured to enhance and highlight the display of the tattoo, for example the opening and patch can have a heart or star shape.

To accentuate the tattoo, the transparent material 22 can have conventional magnification properties. Optionally, this transparent material can be colorized so as to alter the appearance of the tattoo without taking away from its uniqueness. Further still, the transparent material can be both magnified and colorized, giving yet another final appearance to the item being displayed.

This will provide an overall product 10 will can be customized to the wearer's desires and needs. The opening (s) can easily be reconfigured in size and shape. For example, for a tattoo which is located completely around the circumference of the wearer's biceps, the patch will be configured to completely surround the tattoo. Hence, the patch will be a rectangular piece of transparent fabric which completely surrounds the biceps area of a sleeve of a shirt.

In the removable arrangement, the user can have a plurality of transparent patches fabricated from the transparent material which is either colorized, varied in magnification, or a combination thereof, so as to attach the desired patch for a desire affect for displaying the tattoo.

The present invention provides a need and an acceptance in the fashion industry for individuals who have either permanent or temporary tattoos. The invention 10 is also designed and configured to be washable, providing a final product which is user friendly and durable.

In addition, the material used for the line of clothing in the final product can be breathable, so as to provide a means of dissipating heat. This may be extremely desirable if the display window is extremely large and the wearer is outdoors and exposed to the sun.

While the invention has been particularly shown and described with reference to an embodiment thereof, it will be understood by those skilled in the art that various changes in form and detail may be made without departing from the spirit and scope of the invention.

We claim:

1. An article of clothing comprising:

an interior and an exterior;

said interior will be facing a wearer;

at least one through hole extends entirely through said clothing;

a transparent material is secured via a securing means to said through hole;

said transparent material is adapted to contact and display said wearer for providing no obstruction to be located between said wearer and said transparent material; and wherein said transparent material and said through hole will frame and display an item located on said wearer.

2. An article as in claim 1 wherein said transparent material is secured permanently via said securing means to provide for a permanent securing means.

3. An article of clothing as in claim 1 wherein said transparent material is secured removably via said securing means to provide for a removably securing means.

4. An article of clothing as in claim 1 wherein said transparent material is colorized.

5. An article of clothing as in claim 1 wherein said transparent material includes magnification properties.

6. An article of clothing as in claim 4 wherein said transparent material includes magnification properties.

7. An article of clothing comprising:

an interior and an exterior;

said interior will be facing a wearer;

at least one through hole extends through said clothing;

a transparent material is secured via a securing means to said through hole;

said transparent material and said through hole will frame and display an item located thereunder; and said transparent material is colorized.

8. An article of clothing as in claim 7 wherein said securing means comprises hook and loop material.

9. An article of clothing as in claim 8 wherein said hook and loop material is secured in proximity to an edge of each transparent patch and cooperating hook and loop material is secured to said interior of said clothing in proximity to an edge of each through hole.

10. An article of clothing as in claim 9 wherein said hook and loop material is secured to said interior of said clothing providing interiorly locating said securing means.

11. An article of clothing as in claim 10 wherein at least one transparent patch includes magnification properties.

12. An article of clothing as in claim 10 wherein a plurality of patches are provided and each patch is removably secured to each through hole, said plurality of patches each include a different color.

13. An article of clothing as in claim 7 wherein at least one transparent patch includes magnification properties.

14. An article of clothing comprising:

an interior and an exterior;

said interior will be facing a wearer;

at least one through hole extends through said clothing;

a transparent material is secured via a securing means to said through hole;

said transparent material and said through hole will frame and display an item located thereunder; and said transparent material includes magnification properties.

15. An article of clothing as in claim 14 wherein a plurality of patches are provided and each patch is removably secured to each through hole, said plurality of patches each include a different color.

16. An article of clothing as in claim 14 wherein said securing means comprises hook and loop material.

17. An article of clothing as in claim 16 wherein a plurality of patches are provided and each patch is removably secured to each through hole, said plurality of patches each include a different color.

18. An article of clothing as in claim 14 wherein said transparent material is secured permanently via said securing means.

19. An article of clothing as in claim 18 wherein said transparent material is colorized.

* * * * *